US007962974B2

(12) United States Patent
Lanier

(10) Patent No.: US 7,962,974 B2
(45) Date of Patent: Jun. 21, 2011

(54) PLUNGER SYSTEM AND METHOD

(76) Inventor: Justin Lee Lanier, Kennesaw, GA (US)

( * ) Notice: Subject to any disclaimer, the term of this patent is extended or adjusted under 35 U.S.C. 154(b) by 0 days.

(21) Appl. No.: 12/655,880

(22) Filed: Jan. 8, 2010

(65) Prior Publication Data

US 2010/0180366 A1 Jul. 22, 2010

(51) Int. Cl.
*E03D 9/00* (2006.01)

(52) U.S. Cl. ..... 4/255.02; 4/255.01; 4/255.03; 4/255.08

(58) Field of Classification Search ..... 4/255.08, 4/255.01–255.04, 255.11, 255.12
See application file for complete search history.

(56) References Cited

U.S. PATENT DOCUMENTS 3,707,301 A * 12/1972 Rauls ..... 4/255.04
3,808,611 A * 5/1974 Neuman ..... 4/255.08
5,239,708 A * 8/1993 Irwin ..... 4/255.08
6,393,625 B1 * 5/2002 Tsai ..... 4/255.02
6,907,622 B2 * 6/2005 Rasaei et al. ..... 4/255.04

* cited by examiner

*Primary Examiner* — Tuan N Nguyen

(57) ABSTRACT

A system and method for a plunger for unclogging a toilet. A plunger system comprising an elongated cylinder, a flexible material at a first end of the elongated cylinder, an air reservoir located inside the cylinder having an outlet extending through the flexible material, and a valve adapted to release compressed air stored inside the air reservoir through the outlet. The flexible material is capable of being expanded to seal the exit port of a toilet. A method for unclogging a toilet with a plunger device comprising the following steps: inserting a first end of a plunger device into an exit port of the toilet, expanding a flexible material attached to the first end of the plunger device to seal the exit port, and releasing a bolus of air into the exit port past the flexible material to unclog the toilet.

10 Claims, 10 Drawing Sheets

PLUNGER SYSTEM AND METHOD

CROSS REFERENCE TO RELATED APPLICATIONS

This application claims the benefit of and priority to U.S. Provisional Patent Application Ser. No. 60/555,748, entitled "Concealed plunger and concealed toilet brush," filed Mar. 23, 2004, which is incorporated herein by reference in its entirety. This application further claims priority to U.S. patent application Ser. No. 11/084,708, entitled "Plunger System and Method," filed Mar. 19, 2005, which is incorporated herein by reference in its entirety.

TECHNICAL FIELD

The present invention is generally related to clog eliminating systems and, more particularly, is related to a system and method for a plunger for unclogging toilets.

BACKGROUND OF THE INVENTION

Toilets commonly become clogged due to materials being lodged in traps, elbows, and channels in the toilet. Standard plungers are simple to use but can be very messy. Standard plungers attempt to form a seal near the bottom of the bowl of a toilet by encircling the exit port of the toilet. With the changes in the exit ports of toilets over the years many of which involve irregular shaped bowl bottoms or irregular shaped exit ports, standard plungers or plungers that use a similar type of seal do not form a good seal with the toilets. Without a good seal the plunger is not very efficient or effective and often causes a lot of splashing of water out of the toilet bowl. In addition standard plungers are not very attractive when sitting on the floor of a bathroom and can create a mess if stored in a cabinet.

Thus, a heretofore unaddressed need exists in the field of plungers to address the aforementioned deficiencies and inadequacies.

SUMMARY OF THE INVENTION

Embodiments of the present invention provide a system and method for unclogging a toilet using a plunger that creates a seal within an exit port of the toilet, not around the outside edge of the exit port, and dislodges the clog with a bolus of air.

Briefly described, in architecture, one embodiment of the system, among others, can be implemented as follows. A plunger system comprising an elongated cylinder, a flexible material at a first end of the elongated cylinder, an air reservoir located inside the cylinder having an outlet extending through the flexible material, and a valve adapted to release compressed air stored inside the air reservoir through the outlet. The flexible material is capable of being expanded to seal the exit port of a toilet.

Embodiments of the present invention can also be viewed as providing methods for unclogging a toilet with a plunger system. In this regard, one embodiment of such a method, among others, can be broadly summarized by the following steps: inserting a first end of a plunger device into an exit port of the toilet, expanding a flexible material attached to the first end of the plunger device to seal the exit port, and releasing a bolus of air into the exit port past the flexible material to unclog the toilet.

Other systems, methods, features, and advantages of the present invention will be or become apparent to one with skill in the art upon examination of the following drawings and detailed description. It is intended that all such additional systems, methods, features, and advantages be included within this description, be within the scope of the present invention, and be protected by the accompanying claims.

BRIEF DESCRIPTION OF THE DRAWINGS

Many aspects of the invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION OF THE PREFERRED EMBODIMENT

The plunger system and method of the present invention permits people to unclog their toilets with a device that is easy to use, efficient in operation, and attractive to view. The plunger system includes an elongated tube, a flexible sealing material, and an air reservoir.

Figure 1:
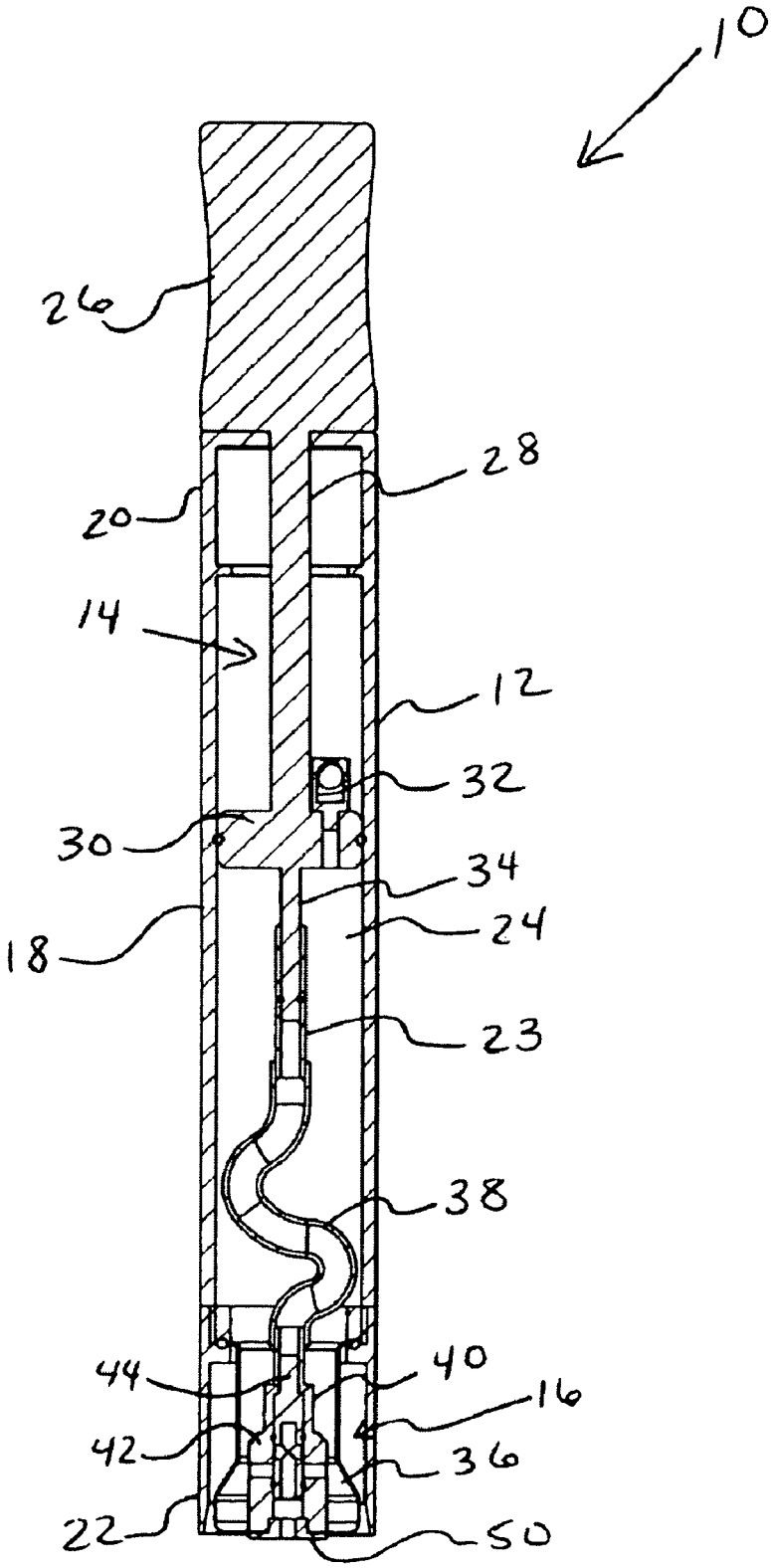
FIG. 1 is a cross-sectional view of a plunger system according to one embodiment of the present invention.

Referring to FIG. 1, a first embodiment of the present invention is shown. The plunger system 10 is shown in a relaxed mode and includes a main body 12, an air pressure generator 14, and a sealing mechanism 16. The main body 12 includes an elongated tube 18, a top end 20 housing the air pressure generator 14, a bottom end 22 housing the sealing mechanism 16, a transfer tube 23, and an air reservoir 24. The air pressure generator 14 includes a handle 26, a pumping rod 28, a piston 30, a check valve 32, and a transfer rod 34. The sealing mechanism 16 includes an inflatable flexible material 36, a flexible transfer tube 38, and a valve 40. In the relaxed mode the handle 26 is near the top end 20 of the main body 12 and the sealing mechanism 16 is concealing within the bottom end 22.

Figure 2:
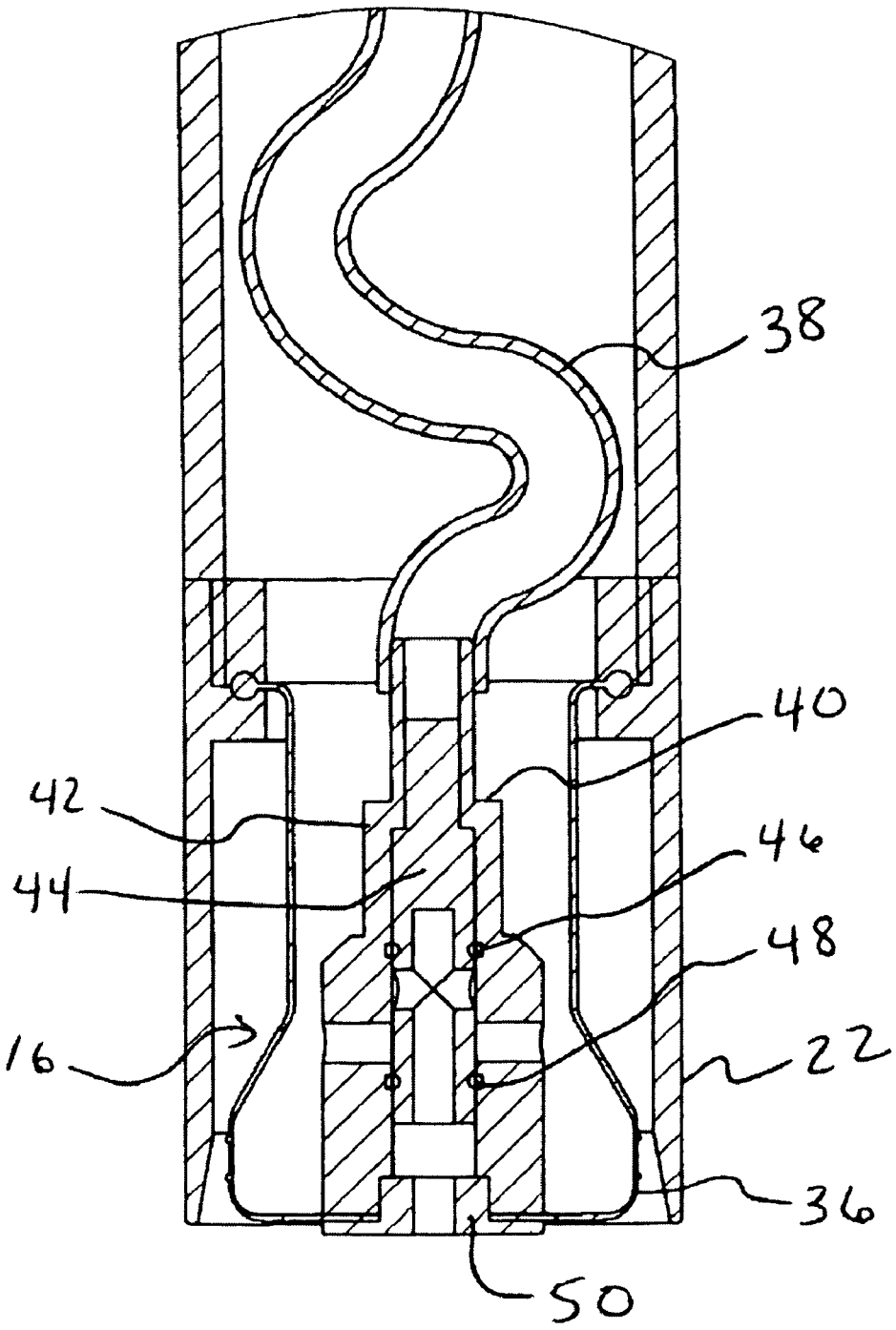
FIG. 2 is an enlarged cross-sectional view of a sealing mechanism for the plunger system of FIG. 1.

Referring now to FIG. 2, an enlarged view of the bottom end 22 and sealing mechanism 16 is shown. The valve 40 includes a valve body 42, a valve piston 44, valve O-ring seals 46, 48, and valve capture 50. The valve 40 controls a bolus of air used to remove the clog.

Figure 3:
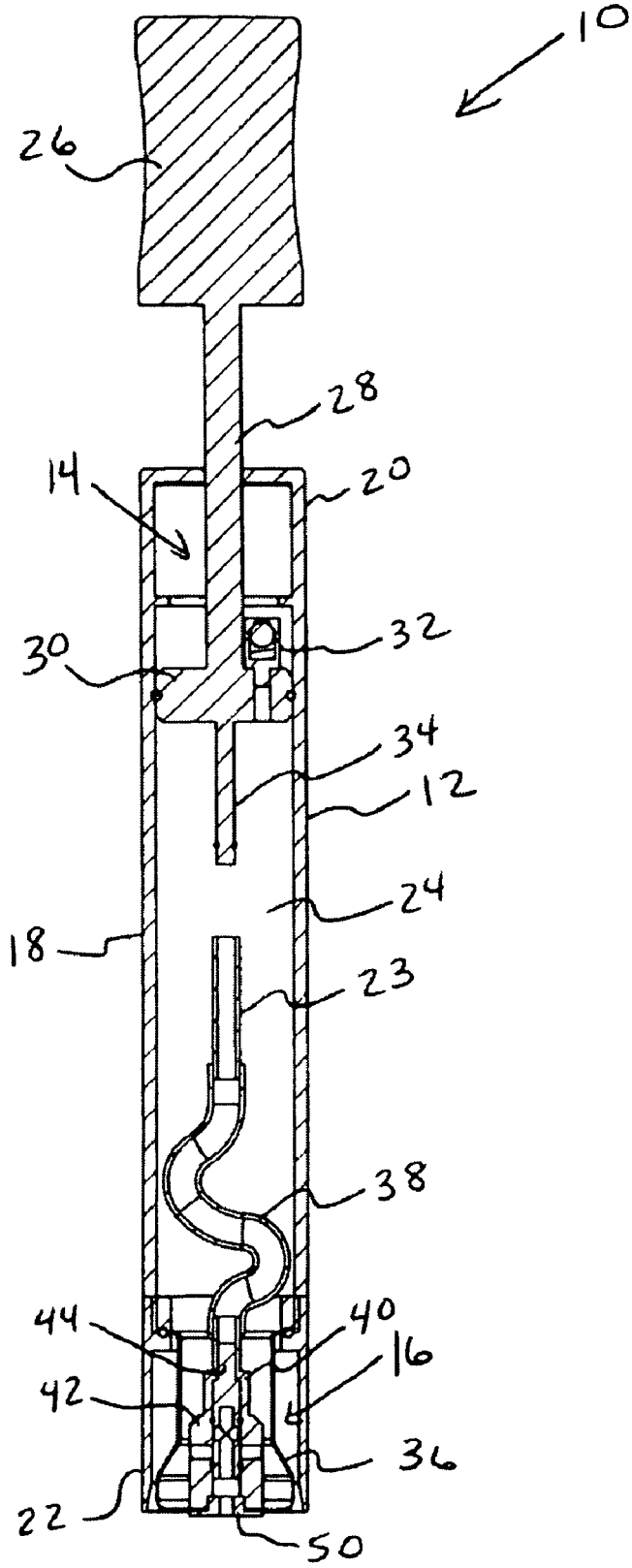
FIG. 3 is a cross-sectional view of the plunger system of FIG. 1 in operation after an upstroke.

FIGS. 3-6 show the plunger system in its operating positions. FIG. 3 shows the handle 26 in the extended position after an upstroke. When the handle 26 is moved from its initial position as shown in FIG. 1 to the extended position, the check valve 32 is open allowing air into the air reservoir 24 through the piston 30. The inflatable flexible material 36 is shown concealed in the main body 12, but may be extended after an upstroke if a down-stroke previously performed.

Figure 4:
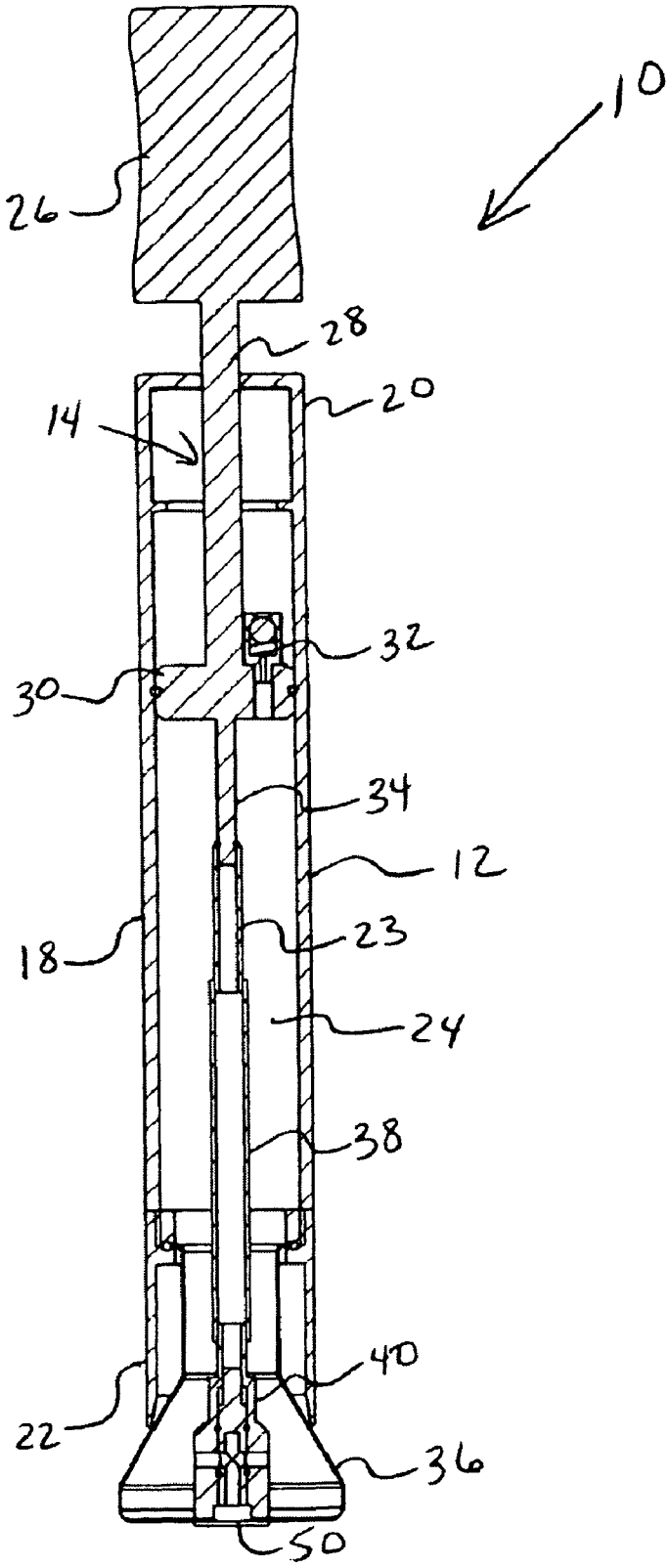
FIG. 4 is a cross-sectional view of the plunger system of FIG. 1 in operation after a down-stroke.
Figure 5:
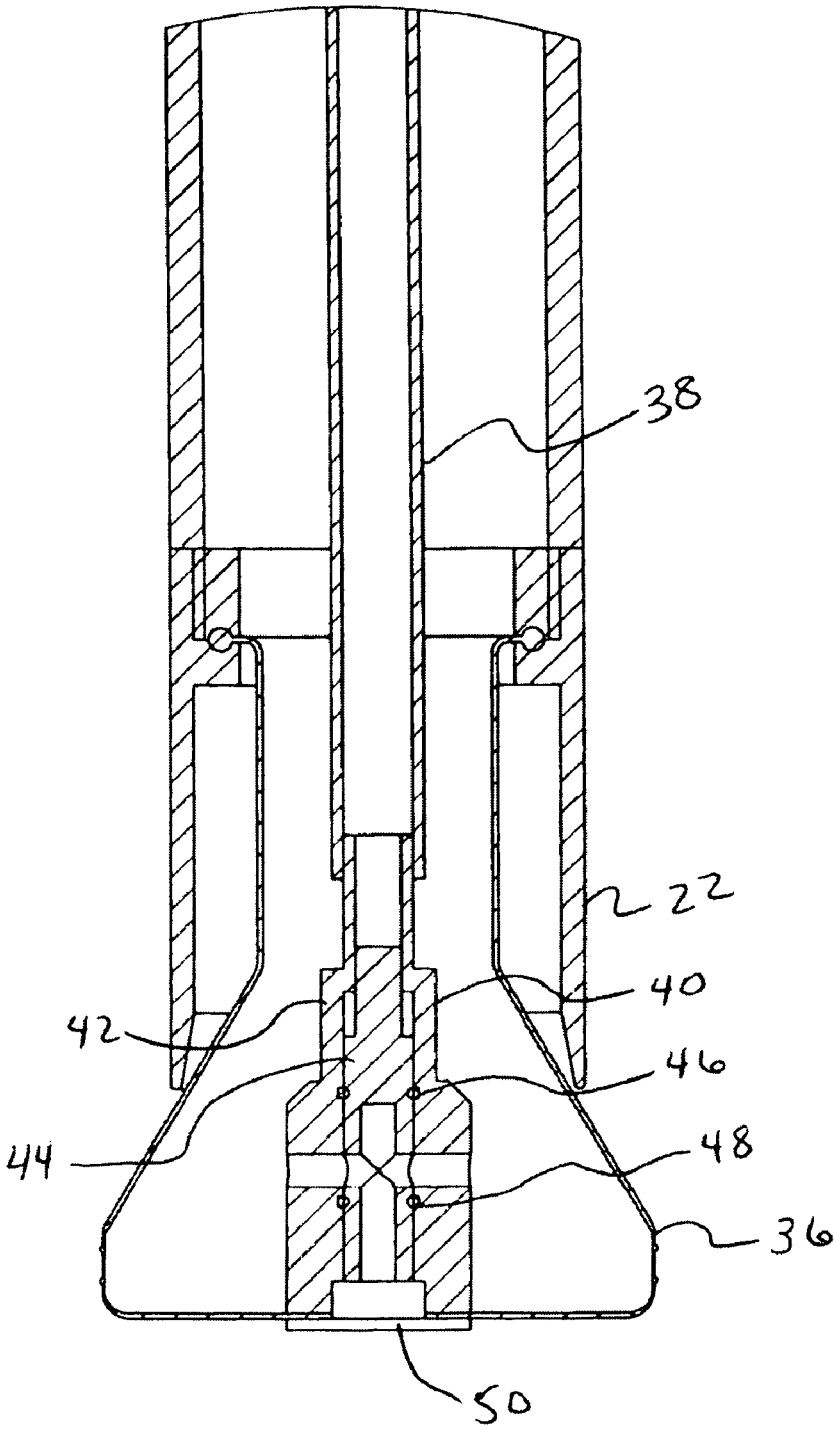
FIG. 5 is an enlarged cross-sectional view of the sealing mechanism for the plunger system of FIG. 4.

Referring now to FIGS. 4 and 5, the plunger system in the deployed state is shown after a down-stroke. When the handle 26 is moved from its extended position to its retracted position, the check valve 32 is closed allowing piston 30 to compress the air in the air reservoir 24. Increasing pressure in the air reservoir 24, increases pressure in the inflatable flexible material 36 causing it to inflate and extend out of the bottom end 22 of the main body. When the inflatable flexible material 36 is extended out the bottom end 22, the flexible transfer tube 38 extended. During the down-stroke the transfer rod 34 enters the transfer tube 23 which is attached to the main body 12. As the transfer rod 34 advances down the transfer tube 23, the air pressure within the transfer tube 23 and flexible transfer tube 38 increases. When the pressure in the transfer tube 23 and flexible transfer tube 38 is great enough to overcome the friction between the valve piston 44 and valve O-ring seals 46 and 48 in valve body 42, the valve piston 44 is moved downward within valve body 42 opening valve 40 and allowing a bolus of air to be release out valve capture 50.

Figure 6:
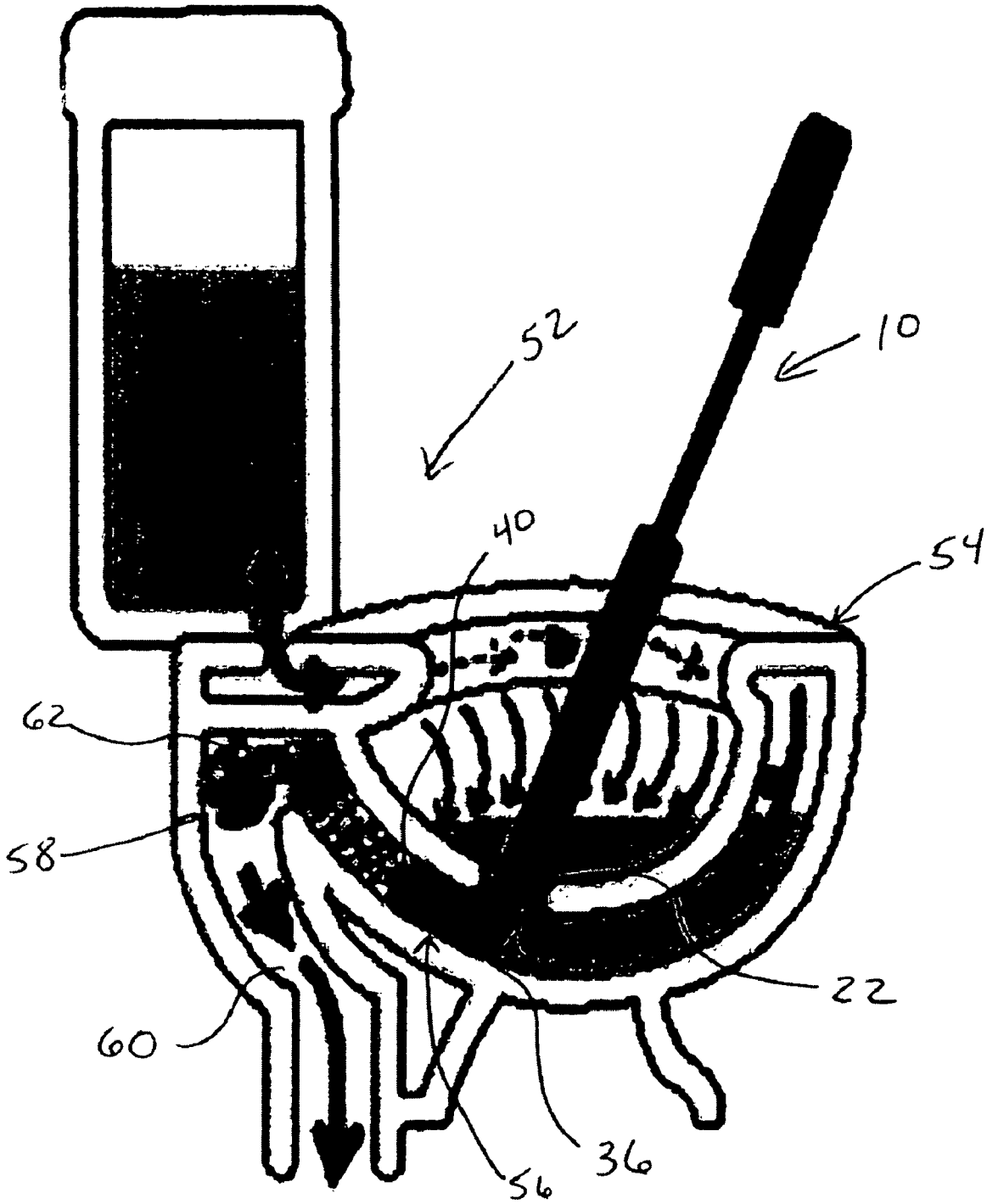
FIG. 6 is a partial cross-sectional view of a plunger system in use removing a clog from a toilet.

Referring now to FIG. 6, the plunger system in use in a toilet 52 is shown. The toilet 52 includes a bowl 54, an exit port 56, an elbow 58, and drain channel 60. A clog 62 is shown at the elbow 58. As shown, bottom end 22 of plunger system 10 is inserted into the exit port 56 of toilet 52. Inflated flexible material 36 extends out of the bottom end 22 and expands creating a seal against the interior of the exit port 56. When the bolus of air is released through valve 40, the clog 62 in the elbow 58 will be pushed past the elbow 58, through the drain channel 60, and down the drain for the toilet.

Figure 7:
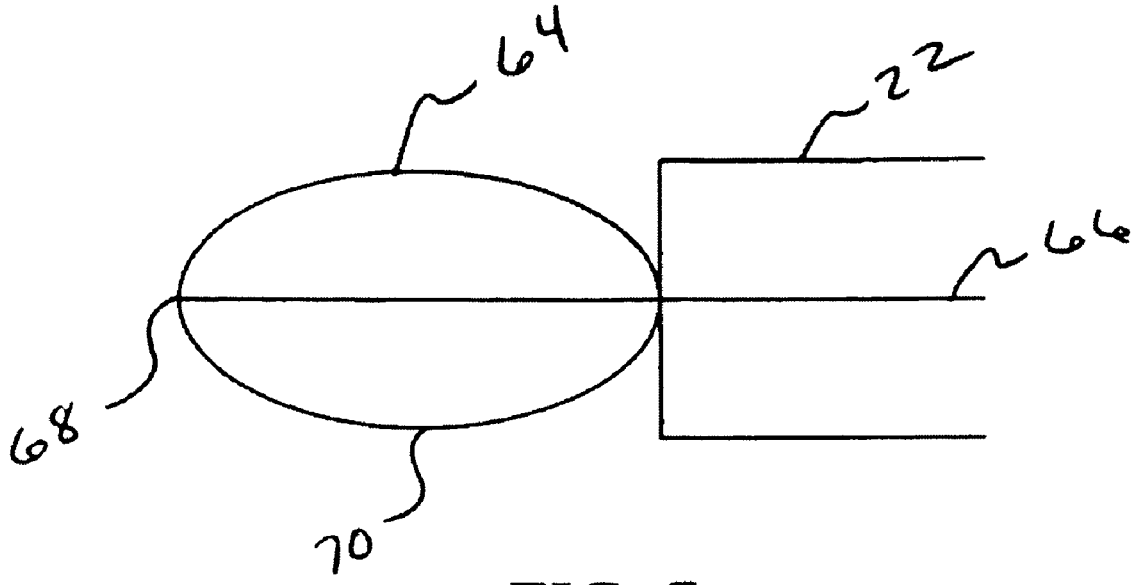
FIG. 7 is a cross-sectional view of a plunger system according to a second embodiment of the present invention.
Figure 8:
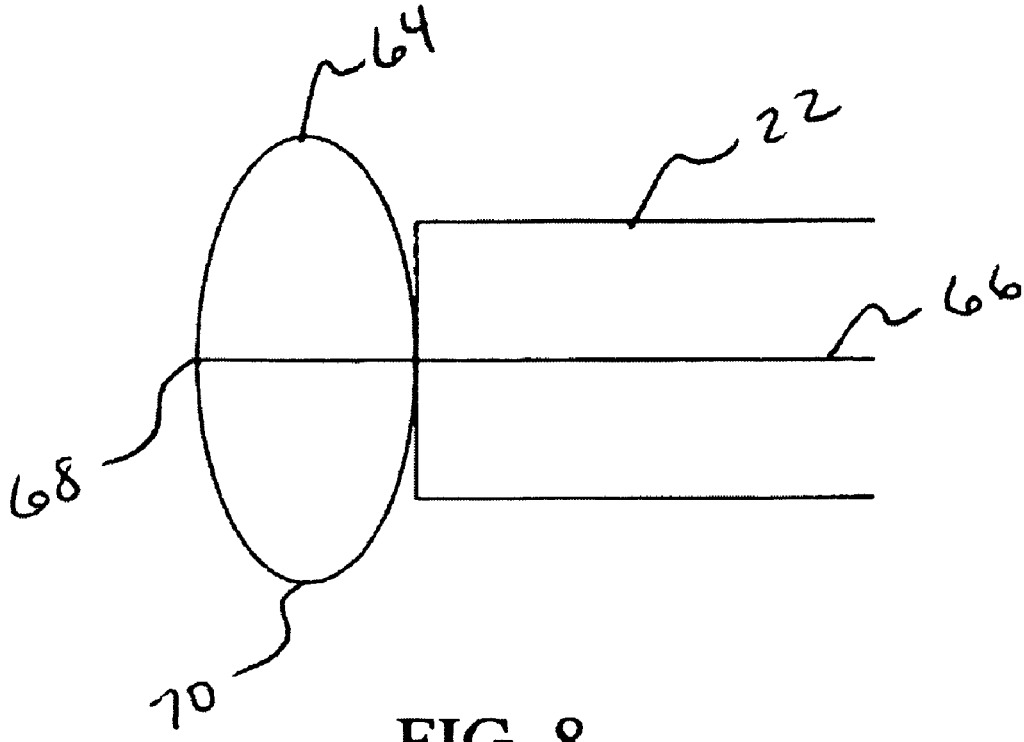
FIG. 8 is a cross-sectional view of the plunger system of FIG. 7 with the sealing mechanism in the deployed state.

Referring now to FIGS. 7 and 8, a second embodiment of the present invention is shown. In this embodiment the inflatable flexible material is replaced with a deformable flexible material 64 at the bottom end 22 of the main body 12. FIG. 7 shows the deformable flexible material 64 in a relaxed state such that in can be retracted into the bottom end 22 or can be hidden by a sliding cover (not shown). FIG. 8 shows the deformable flexible material 64 in a deployed state. A deforming member 66 is attached to an end 68 of the deformable flexible material 64 and when pulled, turned, or ratcheted it brings the end 68 closer to the second end of the main body 12 causing side 70 of the deformable flexible material 64 to expand. In the deployed state the deformable flexible material creates a seal on the interior of the exit port of a toilet.

Figure 9:
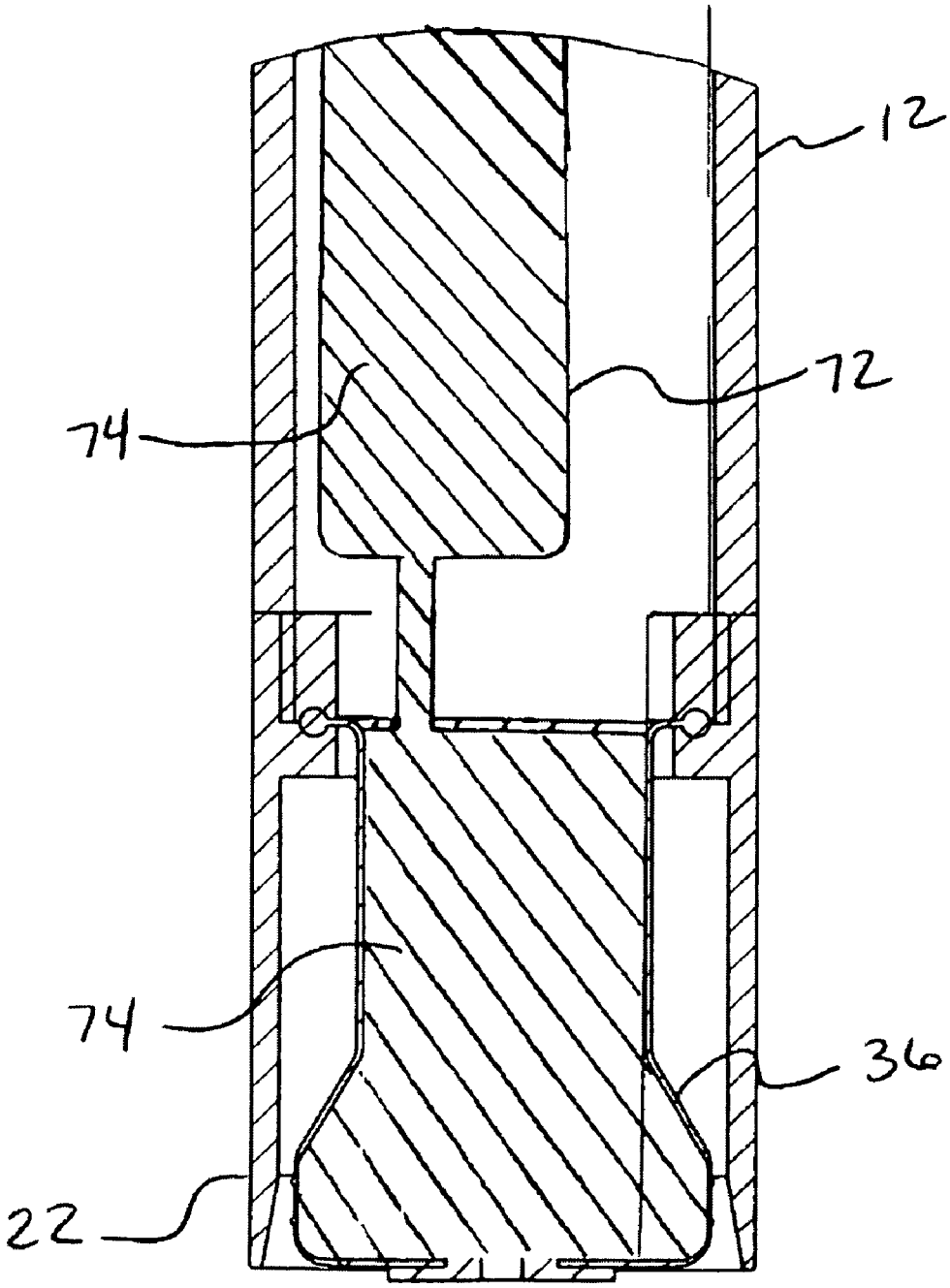
FIG. 9 is a cross-sectional view of a plunger system according to another embodiment of the present invention.
Figure 10:
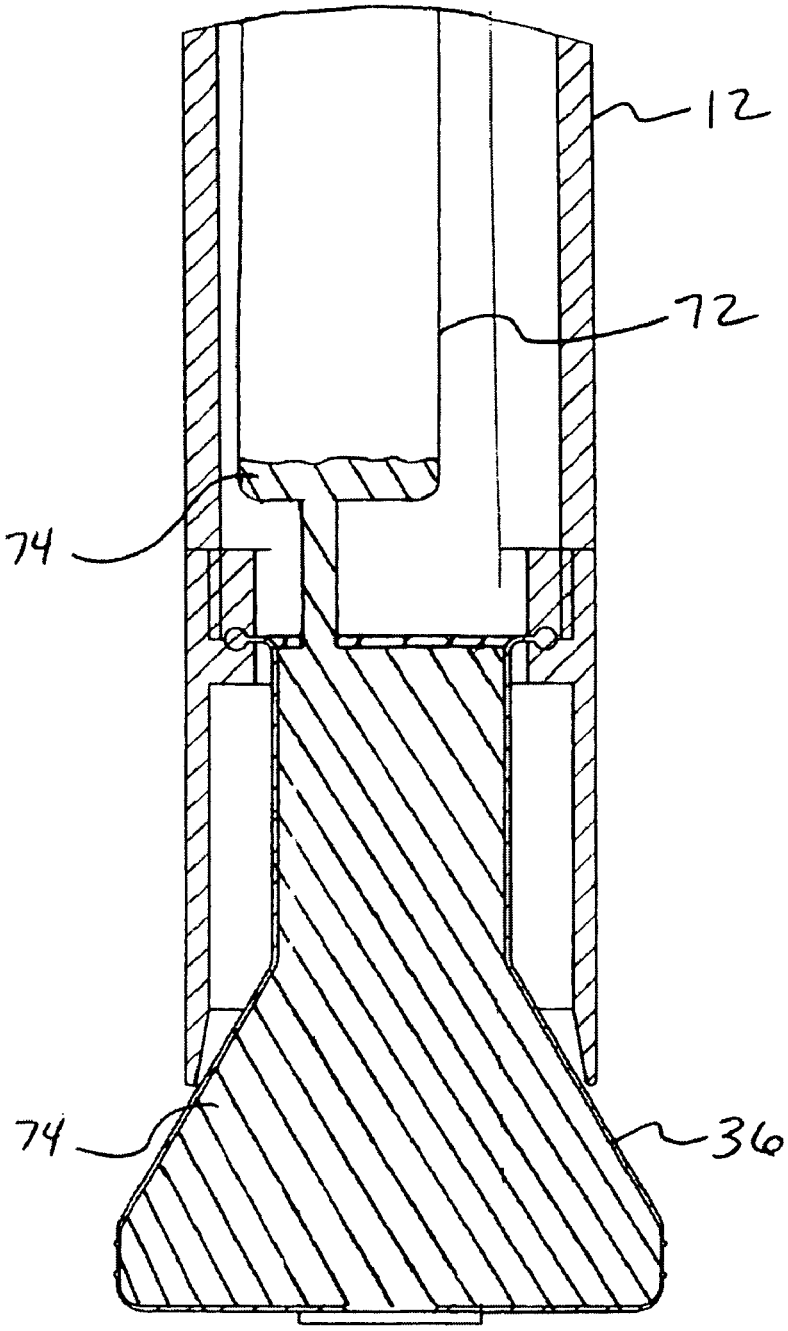
FIG. 10 is a cross-sectional view of the plunger system of FIG. 9 with the sealing mechanism in the deployed state.

Referring now to FIGS. 9 and 10, third embodiment of the present invention is shown. In this embodiment a separate fluid reservoir 72 with fluid 74 is added to the main body 12 for inflating the inflatable flexible material 36. FIG. 9 shows the inflatable flexible material 36 in the relaxed position and the fluid 74 in the fluid reservoir 72. FIG. 10 shows the inflatable flexible material 36 in the deployed position with fluid 74 used to inflate the inflatable flexible material 36. As in the first embodiment the inflatable flexible material 36 in the deployed position creates a seal within the interior of the exit port of the toilet.

Figure 11:
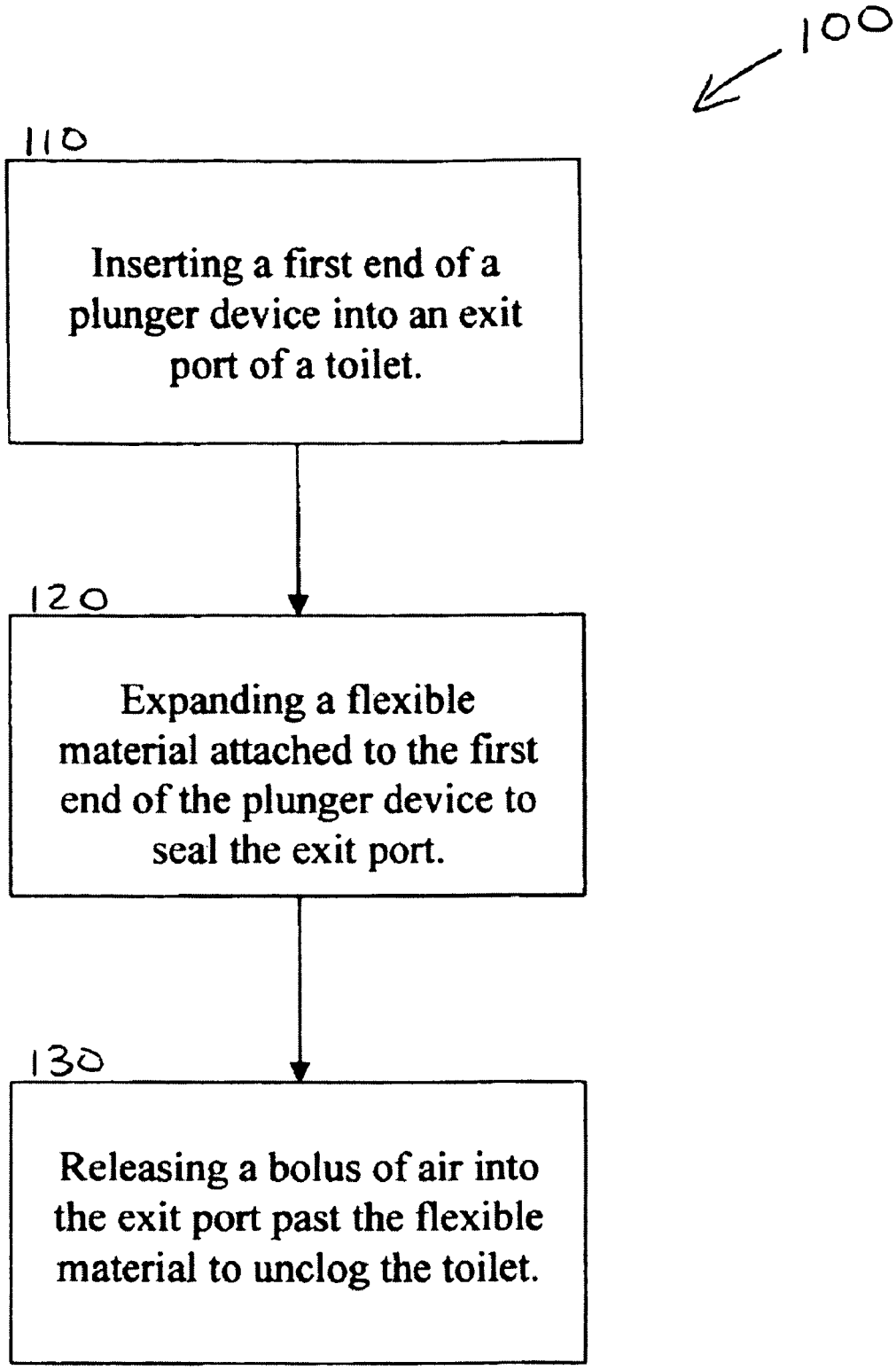
FIG. 11 is a block diagram of one embodiment of a method of the present invention.

Referring now to FIG. 11, an embodiment of a method of unclogging a toilet is shown.

The method 100 includes step 110 of inserting a first end of a plunger device into an exit port of the toilet. In step 120 a flexible material attached to the first end of the plunger device is expanded to seal the exit port. In step 130 a bolus of air is released into the exit port past the flexible material to unclog the toilet.

The various methods of expanding the flexible material attached to the plunger device as described in the embodiments above can all be use in the method 100.

The plunger system and method of the present invention allows the unclogging of a toilet in a convenient and easy manner. The plunger system is capable of being manufactured with a variety of materials and in a variety of styles to allow it to conform to the décor of any bathroom, thus eliminating the unsightly plunger.

It should be emphasized that the above-described embodiments of the present invention, particularly, any "preferred" embodiments, are merely possible examples of implementations, merely set forth for a clear understanding of the principles of the invention. Many variations and modifications may be made to the above-described embodiment(s) of the invention without departing substantially from the spirit and principles of the invention. All such modifications and variations are intended to be included herein within the scope of this disclosure and the present invention and protected by the following claims.

Therefore, having thus described the invention, at least the following is claimed:

1. A device for unclogging a toilet comprising:
- an outer container;
- a flexible material at a first end of the outer container;
- an air reservoir located within the outer container and in communication with the flexible material;
- a valve located within the flexible material and in communication with the air reservoir;
- a nozzle extending outside the flexible material and in communication with the air reservoir; and
- a handle attached to a second end of the outer container adapted to be moved in an upstroke and a down-stroke, wherein pressure within the air reservoir is increased during both the upstroke and down-stroke, the flexible material is inflated when the pressure increases, the valve is opened during a down-stroke releasing a bolus of air.

2. The device of claim 1, wherein the flexible material is inflated inside an exit port of the toilet.

3. The device of claim 1, wherein the handle includes a piston located in the interior of the outer container.

4. The device of claim 3, wherein the piston includes a check valve.

5. The device of claim 1, wherein the handle includes a transfer rod.

6. The device of claim 5, further comprising a transfer tube attached to the outer container to receive the transfer rod.

7. The device of claim 6, further comprising a flexible transfer tube connecting the transfer tube to the valve.

8. The device of claim 1, wherein the flexible material resides into the outer container when not inflated.

9. The device of claim 1, wherein the flexible material creates a seal inside the exit port when inflated inside the exit port.

10. The device of claim 1, further including a fluid reservoir wherein the flexible material is expanded by filling with a fluid obtained from the fluid reservoir.

* * * * *